US007854643B2

(12) United States Patent
Kane

(10) Patent No.: US 7,854,643 B2
(45) Date of Patent: Dec. 21, 2010

(54) DOLL PAIR AND APPARATUS FOR CHEERLEADING STUNTS

(75) Inventor: Erika Kane, San Pedro, CA (US)

(73) Assignee: Mattel, Inc., El Segundo, CA (US)

( * ) Notice: Subject to any disclaimer, the term of this patent is extended or adjusted under 35 U.S.C. 154(b) by 432 days.

(21) Appl. No.: 11/818,111

(22) Filed: Jun. 12, 2007

(65) Prior Publication Data

US 2007/0287356 A1 Dec. 13, 2007

Related U.S. Application Data

(60) Provisional application No. 60/813,159, filed on Jun. 12, 2006, now abandoned.

(51) Int. Cl.
*A63H 3/20* (2006.01)

(52) U.S. Cl. ..... 446/330; 446/331

(58) Field of Classification Search ..... 446/330, 446/331

See application file for complete search history.

(56) References Cited

U.S. PATENT DOCUMENTS

| | | | | |
|---|---|---|---|---|
| 182,194 | A | 9/1876 | Hubbell | |
| 560,728 | A | 5/1896 | Luckenbach | |
| 839,145 | A | 12/1906 | Hoffman | |
| 1,265,803 | A | 5/1918 | Meurer | |
| 1,476,859 | A * | 12/1923 | Vaughan | 446/322 |
| 1,666,417 | A | 4/1928 | Harris | |
| 1,711,150 | A * | 4/1929 | Likes | 446/322 |
| 1,714,537 | A | 5/1929 | Youngquist | |
| 1,725,870 | A | 8/1929 | Kucher | |
| 1,817,959 | A | 8/1931 | Bloxom | |
| 1,848,257 | A * | 3/1932 | Lewis | 446/314 |
| 2,527,109 | A | 10/1950 | Vasquez | |
| 2,638,348 | A | 5/1953 | Arensen et al. | |
| 2,697,302 | A | 12/1954 | Solomon | |
| 2,713,748 | A | 7/1955 | Glass | |
| 3,074,720 | A | 1/1963 | Carver et al. | |
| 3,172,401 | A | 3/1965 | Bullen | |
| 3,343,835 | A | 9/1967 | Kaplan | |
| 3,457,671 | A | 7/1969 | Roth | |
| 3,701,215 | A | 10/1972 | Marason, Jr. et al. | |
| 3,742,644 | A | 7/1973 | Williams | |
| 3,758,982 | A | 9/1973 | Lemelson et al. | |
| 3,852,911 | A | 12/1974 | Sapkus et al. | |
| 3,854,239 | A | 12/1974 | Williams | |
| 3,874,112 | A | 4/1975 | Sapkus et al. | |
| 3,888,023 | A | 6/1975 | Genin | |
| 3,927,883 | A | 12/1975 | Bosley et al. | |
| 3,928,934 | A | 12/1975 | Lewis et al. | |
| 3,955,311 | A | 5/1976 | Lyons et al. | |

(Continued)

*Primary Examiner*—Gene Kim
*Assistant Examiner*—Michael D Dennis
(74) *Attorney, Agent, or Firm*—Edell, Shapiro & Finnan LLC

(57) ABSTRACT

A first doll is supported upon a support base in a substantially vertical standing position. A stunt apparatus includes a torso clasp which releasably attaches to the first doll torso and which includes an elongated rod pivotally secured to the torso clasp on the first doll. A second doll is secured to one end of the rod by a torso clasp and pivotal attachment. The remaining end of the rod is formed into a handle suitable for allowing the user to manipulate the second doll with respect to the first doll.

16 Claims, 7 Drawing Sheets

U.S. PATENT DOCUMENTS

| | | | | |
|---|---|---|---|---|
| 4,031,657 | A | | 6/1977 | Crosman et al. |
| 4,091,563 | A | * | 5/1978 | Noble et al. ..... 273/440.1 |
| 4,182,076 | A | | 1/1980 | Gay et al. |
| 4,186,518 | A | | 2/1980 | Luke |
| 4,518,366 | A | | 5/1985 | Fultz, Jr. et al. |
| 5,009,424 | A | | 4/1991 | Harth et al. |
| 5,299,967 | A | | 4/1994 | Gilbert |
| 5,458,523 | A | | 10/1995 | Aoki et al. |
| 6,224,456 | B1 | | 5/2001 | Wittenberg |
| 6,554,680 | B2 | | 4/2003 | Abbondanddo |
| 6,575,808 | B1 | | 6/2003 | Wright et al. |
| 6,776,682 | B2 | | 8/2004 | Engel et al. |
| 6,939,196 | B2 | | 9/2005 | Bellon |
| 2002/0086609 | A1 | | 7/2002 | Donohoe |
| 2005/0170746 | A1 | | 8/2005 | Wee |
| 2005/0191935 | A1 | | 9/2005 | Marine et al. |

* cited by examiner

DOLL PAIR AND APPARATUS FOR CHEERLEADING STUNTS

CROSS-REFERENCE TO RELATED APPLICATIONS

This application claims the benefit of and priority under 35 U.S.C. 119(e) of U.S. Provisional Patent Application No. 60/813,159 entitled DOLL PAIR AND APPARATUS FOR CHEERLEADING STUNTS filed Jun. 12, 2006 in the name of Ericka Kane, the disclosure of which is incorporated herein by reference.

FIELD OF THE INVENTION

This invention relates generally to dolls and particularly to dolls and particularly to accessories and cooperating material used in play patterns therewith.

BACKGROUND OF THE INVENTION

Dolls have been used by children in various play activities for many years. Not surprisingly, practitioners in the art have endeavored to provide a substantial variety of dolls to satisfy consumer needs. One type of doll which has proven to be extremely popular with young girls and has generated a virtually endless variety of cooperating accessories is generally known in the industry as "fashion dolls". Fashion dolls vary some what in size and structure. However, most generally utilize a molded plastic body often having an internal supporting skeleton which is jointed to permit articulation of the doll body. One of the play activities which has proven popular with fashion dolls involves the simulation of various sport and exercise activities.

For example, U.S. Pat. No. 6,776,682 issued to Angel et al. sets forth an ACROBATIC DOLL AND DOLL ACCESSORIES CAPABLE OF ACTIVATION BY AIR in which a doll having a torso, head, first and second arms hingedly coupled to the torso, and first and second legs hingedly coupled to the torso cooperates with an engaging member coupled to the doll body. The engaging member coupled to the doll body includes a doll accessory wherein the engaging member and the doll accessory engage one another in a mating relationship. The doll is able to carry forward various movements and maneuvers which replicate acrobatic performance.

U.S. Pat. No. 3,701,215 issued to Marason, Jr. et al. sets forth a DOLL LIMB JOINT FOR SELECTIVELY ALLOWING FREE ROTATION OF THE LIMB OR RESISTING SAME in which a doll includes a doll body having shoulder portions which are coupled to shoulder joint mechanisms which in turn support pivotally movable arms. The arms include hands adapted to grasp an object such as a trapeze bar or the like. The shoulder joints are configurable to alternatively allow free rotation of the arms with respect to the torso or to resist rotation thereby accomplishing various performance results.

U.S. Pat. No. 2,697,302 issued to Solomon sets forth TOY ACROBATS having a staging apparatus which includes a rotatable transverse bar coupled to a hand crank. A multiply articulated toy figure is resiliently secured to the transverse bar a pair of coupling springs. The articulated figure is joined to and further supports a second articulated figure. As the hand crank is rotated, the transverse bar rotates and produces corresponding movement of the two toy figures to simulate acrobatic performance.

U.S. Pat. No. 2,713,748 issued to Glass sets forth an ACROBATIC FIGURE TOY having a multiply articulated toy figure including upwardly extending arms terminating in hands. The hands are adapted to grasp a horizontal bar held by the user. As the user rotates the horizontal bar, the figure undergoes maneuvers which replicate acrobatic performance.

Additional examples of early acrobatic-type toys are shown in U.S. Pat. No. 1,817,959 issued to Bloxom and U.S. Pat. No. 1,848,257 issued to Lewis.

In a related art, a plurality of toy devices have been provided which allow players to control the movements of toy figures in a boxing or fighting activity. Examples of such toys are found in U.S. Pat. No. 3,927,883 issued to Bosley et al.; U.S. Pat. No. 4,031,657 issued to Crosman et al.; U.S. Pat. No. 5,009,424 issued to Harth et al. and U.S. Pat. No. 5,458,523 issued to Aoki et al. In additional prior art devices, apparatus is provided for manual manipulation of an articulated toy figure or doll in a manner causing the doll to undergo various controlled actions. For example, U.S. Pat. No. 3,874,112 issued to Sapkus et al. sets forth an ANIMATING DEVICE FOR FIGURE TOYS having a toy figure cooperating with a pistol-type hand grip which is swingably connected to the figure toy. The figure toy includes limb moving apparatus which is coupled to the hand grip and is interactive such that the toy figure is cause to move in response to the users actuation of the hand grip trigger lever.

U.S. Pat. No. 4,186,518 issued to Luke sets forth a KICKING DOLL WITH DETACHABLE TRIGGER MEANS having a toy figure which includes moveable limbs such as a pivotally attached kicking leg. A mechanism within the toy figure is operative to cause the kicking leg to pivot rapidly in order to kick a cooperating ball. A removable trigger apparatus is attachable to the rear torso of the figure and is interactively coupled to the kicking leg mechanism such that movement of the apparatus allows the user to trigger a leg kick.

U.S. Pat. No. 3,852,911 issued to Sapkus et al. sets forth a MANUALLY MANIPULATED ANIMATED FIGURE TOY having a puppet supported by a rigid hollow member. The puppet includes multiply articulated limb members which pivot during rotation of the figure. The hollow member is supported by an adjacent stand and is operative to allow the user to rotate the figure and product limb movement and articulation.

U.S. Pat. No. 6,224,456 issued to Whittenberg sets forth a DOLL HAVING AN ARM MOVEMENT MECHANISM USING A REAR-FACING LEVER the doll includes a pair of arms each pivotally joined to the shoulder portion of the doll. One of the arms is coupled to an internal movement mechanism which produces movement of the arm with respect to the shoulder. A traveler operative within the arm moving mechanism includes a rearwardly extending lever passing through an aperture formed in the doll torso. The traveler defines a socket which receives the ball end of the arm shaft supporting the arm in pivotal attachment. As the user moves the lever with respect to the doll torso, the arm shaft is pivoted causing a corresponding pivotal movement of the doll arm.

U.S. Pat. No. 6,554,680 issued to Abbondandolo sets forth SNAP-ON ACTION FIGURES in which an action figure defines a female connection formed in the back portion thereof. The female connection includes a plurality of male connectors. The action figure is connected to a belt for supporting a group of action figures.

U.S. Pat. No. 6,939,196 issued to Bellon and Published U.S. Patent Application US2002/0086609 filed by Donohoe set forth examples of toy figures which are directly manipulated by the hand of a user.

In a further related art, which pertains to puppets and the like, U.S. Pat. No. 4,518,366 issued to Fultz Jr. et al.; U.S. Pat.

No. 3,742,644 issued to Williams; U.S. Pat. No. 3,854,239 issued to Williams; U.S. Pat. No. 3,758,982 issued to Lemelson et al.; U.S. Pat. No. 3,928,934 issued to Lewis et al.; U.S. Pat. No. 3,955,311 issued to Lyons et al.; U.S. Pat. No. 3,888,023 issued to Jenin; U.S. Pat. No. 6,575,808 issued to Wright et al.; U.S. Pat. No. 5,299,967 issued to Gilbert and U.S. Pat. No. 4,182,076 issued Gay et al. show various puppet structures which facilitate hand manipulation of a toy figure. Additionally, Published U.S. Patent Applications US2005/0191935 filed by Marine et al. and US2005/0170746 filed by Wee show structures in which a doll or toy figure is supported upon a base and is manipulated by apparatus also supported by the base.

U.S. Pat. No. 1,725,870 issued to Kucher; U.S. Pat. No. 1,714,537 issued to Younquist; U.S. Pat. No. 1,666,417 issued to Harris; U.S. Pat. No. 1,265,803 issued to Meurer; U.S. Pat. No. 839,145 issued to Hoffman; U.S. Pat. No. 560,728 issued to Luckenbach; U.S. Pat. No. 3,074,720 issued to Carver et al.; U.S. Pat. No. 3,172,401 issued to Pullen; U.S. Pat. No. 3,343,835 issued to Kaplan and U.S. Pat. No. 182,194 issued to Hubbell set forth various examples of early attempts by practitioners to provide acrobatic toys which are manipulated by a user.

Additionally, U.S. Pat. No. 3,457,671 issued to Roth; U.S. Pat. No. 2,527,109 issued to Vasquez and U.S. Pat. No. 2,638,348 issued to Arenson et al. set forth early toy apparatus generally related to the subject matter of the present invention.

While the foregoing described prior art devices have to some extent improved the art and have in some instances enjoyed commercial success, there remains nonetheless a continuing need in the art for ever more amusing, entertaining and interesting toy apparatus which facilitates the performance of various physical activities by dolls and toy figures.

SUMMARY OF THE INVENTION

Accordingly, it is general object of the present invention to provide an improved toy apparatus. It is a more particular object of the present invention to provide an improved toy apparatus which facilitates manipulation and control of a pair of dolls to perform various stunt or acrobatic activities.

In accordance with the present invention, there is provided a doll pair and apparatus for cheerleading stunts. The present invention doll pair and apparatus for cheerleading stunts utilizes a pair of dolls such as fashion dolls garbed in typical cheerleading uniforms. A stand is provided for one of the dolls which includes a mechanism for securing the dolls lower legs and feet to maintain the doll in a stable vertical stance. The apparatus further includes a pair of clasp harnesses which snap fit upon the torsos of the dolls. The apparatus completed by an elongated rod having one end pivotally joined to the freely moveable doll and a midpoint pivotally joined to the clasp harness worn by the doll supported by the support base. The remaining end of the apparatus forms a handle suitable for manipulation by the child user. Both attachments to the clasp harnesses of both dolls are pivotable attachments allowing the dolls and their respective clasp harnesses to rotate. In the typical play pattern, the user grasps the free end of the elongated rod and pivots its downwardly raising the mobile upwardly and bringing it into a position above the doll standing on the base. The object is to bring the mobile doll into a standing position upon the shoulders of the doll fixed to the base. This mimics a typical standing activity used in cheerleading routines. The pivotal attachment of the mobile doll to the end of the elongated rod also allows the user to exercise some skill and cause the mobile doll to somersault and land upon the shoulders of the fixed doll.

From an alternative perspective, the present invention provides a combination first and second dolls and cooperating stunt apparatus, the combination comprising: first and second dolls; a base having means for supporting the first doll in a standing posture upon the base; a first torso clasp secured to the first doll; a second torso clasp secured to the second doll; and a stunt apparatus having an elongated rod having a first end forming a handle and a second end pivotally joined to the second torso clasp and an intermediate pivot between the first and second ends pivotally joining the elongated rod to the first torso clasp.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

By way of overview, the present invention doll pair and apparatus is provided to allow the child user to initiate one or more stunt or cheerleading maneuvers using a pair of dolls and its cooperating apparatus. The doll pair is able to undergo maneuvers such as a shoulder stand as well as somersaulting or tumbling routines as the child user acquires more skill. The doll pair includes a pair of fashion dolls wearing typical cheerleader uniforms together with a support base. The support base receives the feet and lower legs of one doll to maintain the doll in a fixed standing position. An apparatus provides an elongated rod having a handle end and a forward end. Each doll is provided with a torso clasp which snap fits upon the rear torso of the dolls body. Each of the torso clasps includes a pivotal attachment. The doll supported upon the base remains fixed in position and is pivotally secured to the approximate midpoint of the elongated rod. The remaining doll is mobile and is pivotally secured to the forward end of the elongated rod. The user is able to raise the mobile doll by forcing the handle end of the elongated rod downwardly. When properly manipulated, the user is able to raise the mobile doll to a standing position upon the fixed doll in a typical shoulder stand maneuver. When the elongated rod is manipulated with some skill, the child user is able to impart a somersault or tumbling motion to the mobile doll.

Figure 1:
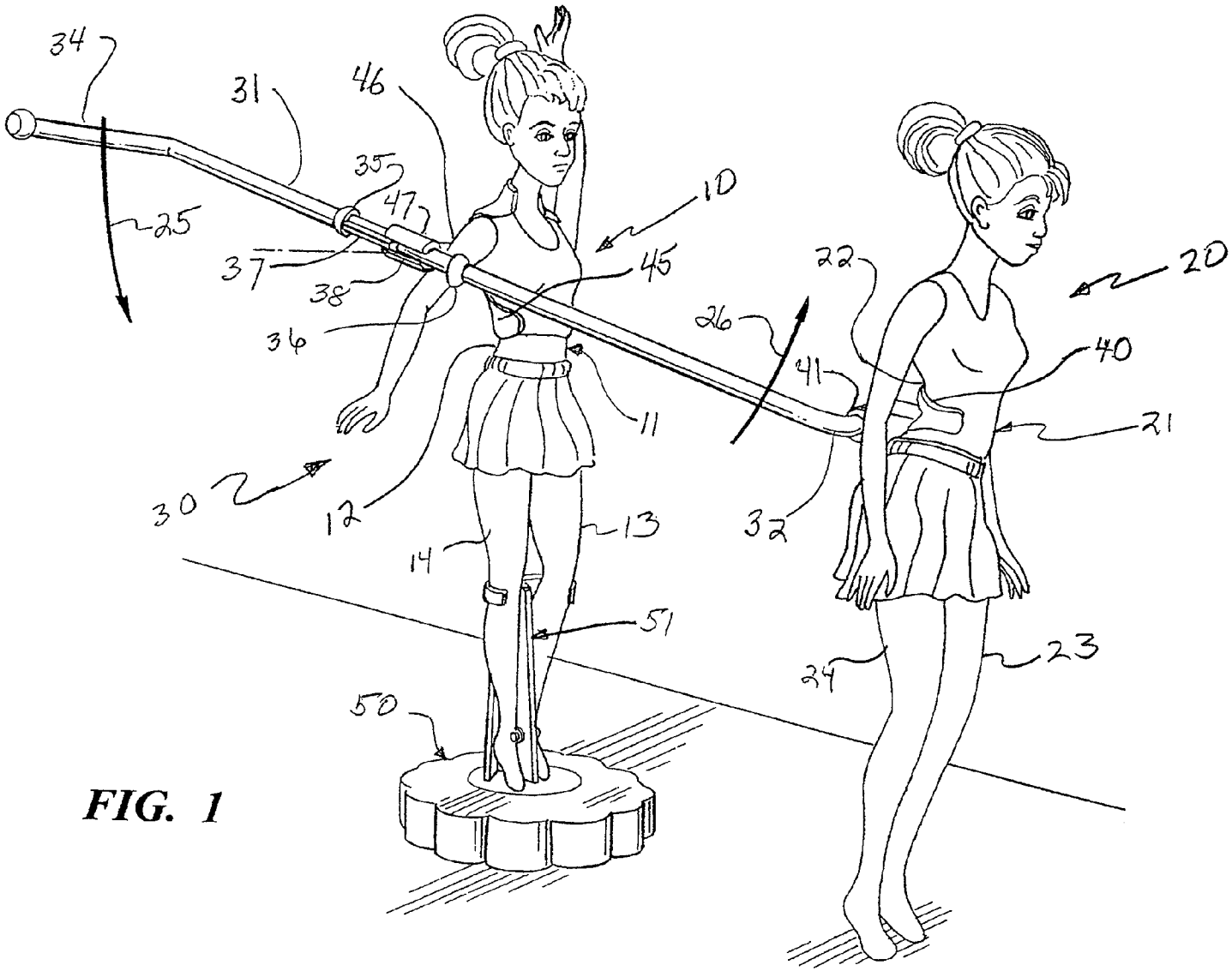
FIG. 1 sets forth a perspective view of a doll pair and apparatus for cheerleading stunts constructed in accordance with the present invention.

FIG. 1 sets forth the present invention doll pair and apparatus for cheerleading stunts showing the doll pair prior to the initiation of a stunt. In the position shown in FIG. 1, both dolls are essentially standing in an upright stance.

More specifically, FIG. 1 sets forth a pair of dolls generally referenced by numerals 10 and 20 together with a manipulating apparatus generally referenced by numeral 30. Dolls 10 and 20 are fabricated generally in accordance with conventional fabrication techniques and include conventional doll bodies 11 and 21 respectively. Doll body 11 defines a rear torso 12 together with legs 13 and 14. Similarly, doll body 21 defines a rear torso 22 together with legs 23 and 24. Apparatus 30 includes an elongated generally rigid rod 31 having an end 33 forming a convenient handle 34 and a forward end 32. Rod 31 further includes a pair of fixed enlarged beads 35 and 36. Apparatus 30 further includes a torso clasp 40 which is snap fit upon doll body 21 and rests against rear torso 22. Torso clasp 40 includes a pivotal attachment 41 which receives end 32 of rod 31. Similarly, a torso clasp 45 is snap fit upon body 11 and is positioned against rear torso 12 of doll 10. Torso clasp 45 includes a pivotal attachment 46 which receives an extension from a slide 47 upon rod 31. Slide 47 is moveable upon rod 31 between beads 35 and 36.

A base 50 formed of a rigid material includes a leg support 51 which receives and secures the feet and lower legs of doll 10 to maintain doll 10 in a vertical stance. Torso clasps 40 and 45 are preferably fabricated of a somewhat resilient elastic rigid plastic material to facilitate their snap fit attachment upon the torsos and waists of dolls 20 and 10 respectively.

In operation, the child user initiates the shoulder stand activity of doll 20 upon doll 10 by pressing handle 34 downwardly in the direction indicated by arrow 25. The pivotal attachment of rod 31 at pivot 46 upon doll 10 together with the rigid vertical stance maintained by base 50 allows pivot 46 to act as a pivot point whereby lowering handle 34 in the direction of arrow 25 raises end 32 of rod 31 upwardly in the direction indicated by arrow 26. The upward movement of end 32 carries doll 20 upwardly in a corresponding movement.

Figure 2:
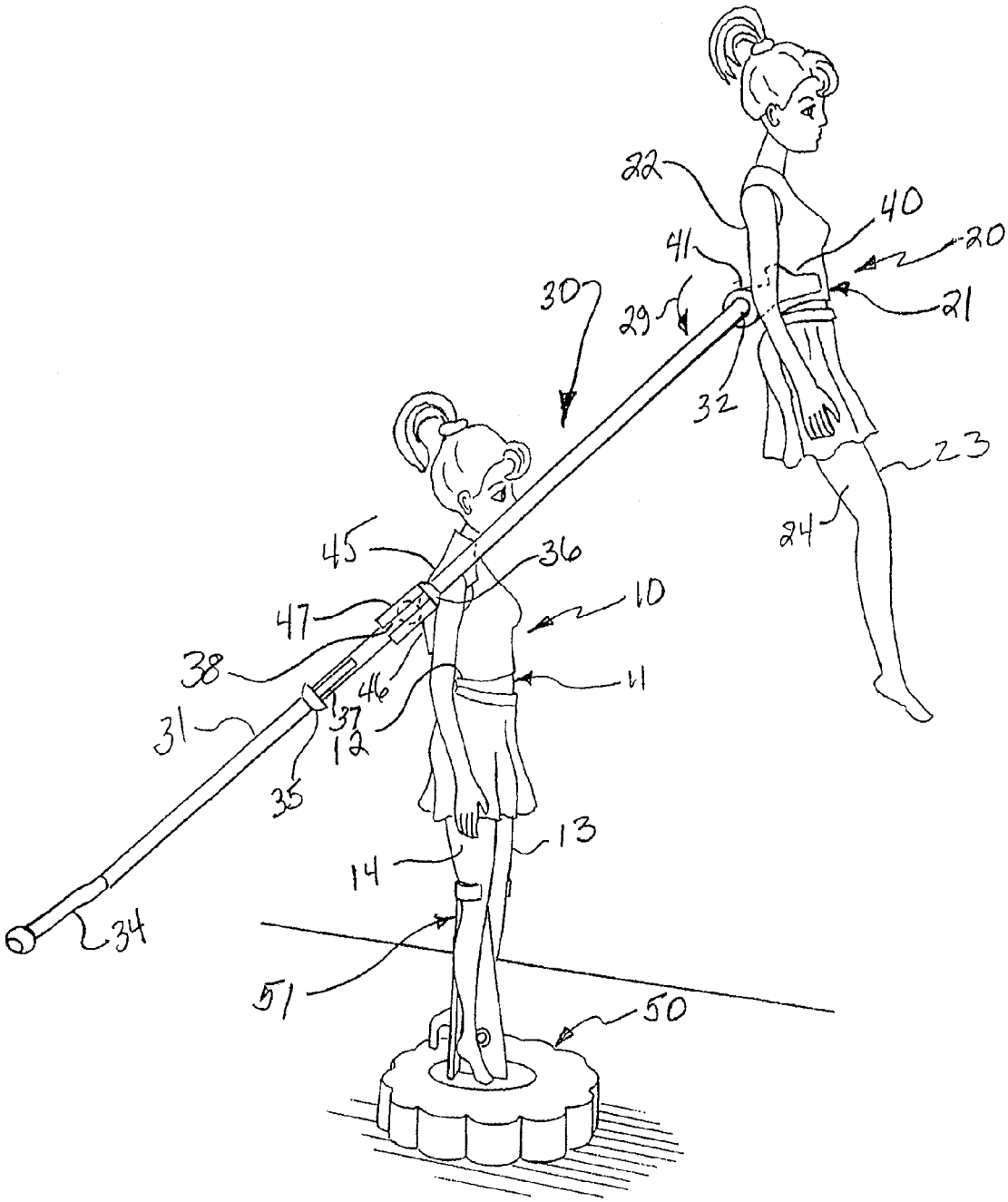
FIG. 2 sets forth a perspective view of the doll pair and apparatus initiating a shoulder stand and maneuver by the doll pair.

FIG. 2 shows the present invention doll pair and apparatus at the approximate mid point of the shoulder stand maneuver resulting from continued pivotal movement of rod 31.

As can be seen, the rigid stance and support of doll 10 allows doll 10 and torso clasp 45 to maintain the pivot point whereby doll 20 may be raised up with the continued downward movement of handle 34 in the direction indicated by arrow 25. Additionally, the pivotal movement of doll 20 as it is raised to the shoulder stand position may be controlled or manipulated by the speed at which the user forces handle 30 downwardly. In the event the user forces handle 34 downwardly in a relatively slow movement, the vertical orientation of doll 20 is generally maintained as pivot 41 allows the doll to move upwardly while maintaining a generally vertical orientation. If however the user moves handle 34 downwardly with some abruptness and speed, pivot 41 is not able to allow doll 20 to adjust orientation as end 32 moves. The result is that doll 20 undergoes a somersaulting motion as it is raised. The somersaulting motion is indicated by arrow 29.

Figure 3:
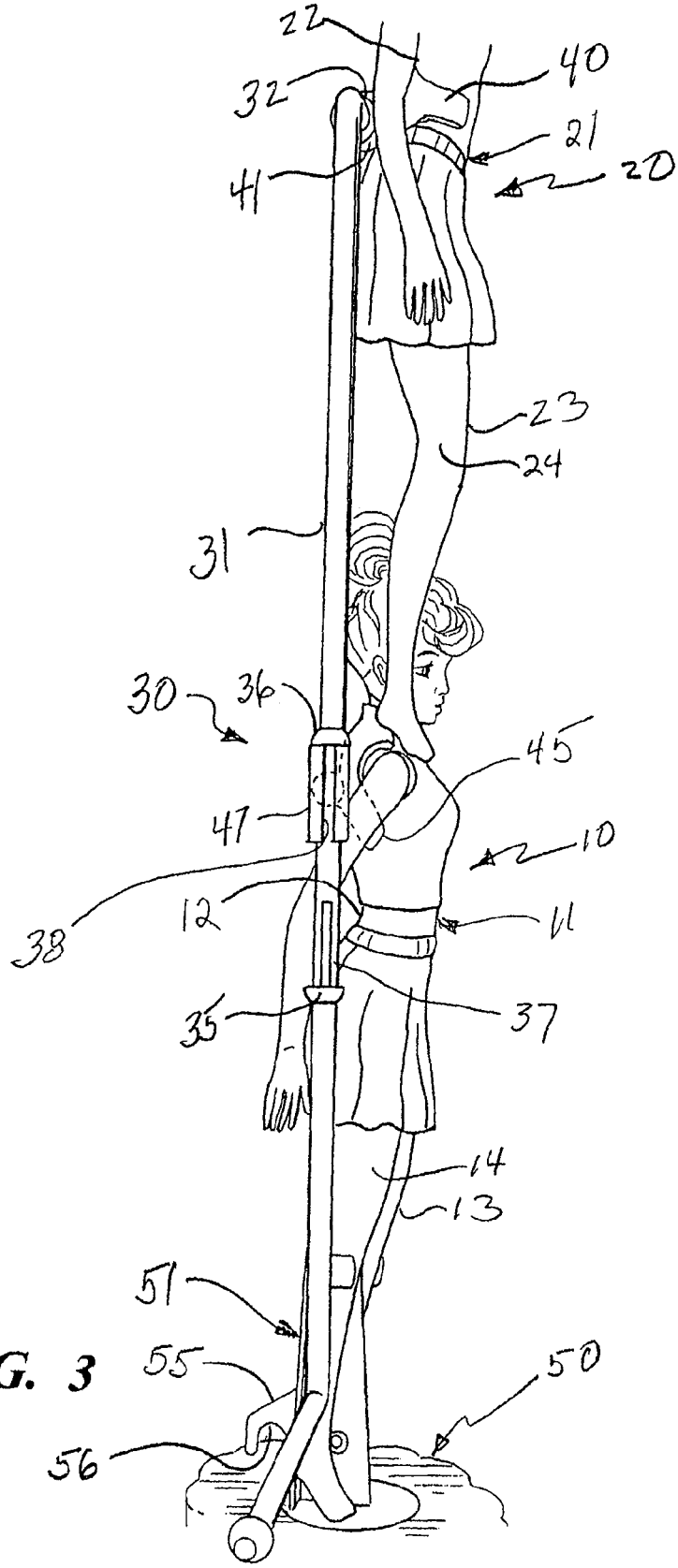
FIG. 3 sets forth a partial side view of the present invention doll pair and apparatus having attained a shoulder stand position.

FIG. 3 sets forth a partial view of the present invention doll pair and apparatus at the completion at the shoulder stand maneuver. As can be seen the shoulder stand maneuver results from the positioning of doll 20 above doll 10 such that the feet of doll 20 overly the shoulders of doll 10. At this point, an important aspect of the present invention is found as base 50 includes a pivoting latch member 55 having a notch 56 formed therein. Latch member 55 may be pivoted to engage handle 34 of elongated rod 31 within notch 56 and thereby secure rod 31 in the vertical position. This in turn secures dolls 10 and 20 in the shoulder stand position also.

Figure 4:
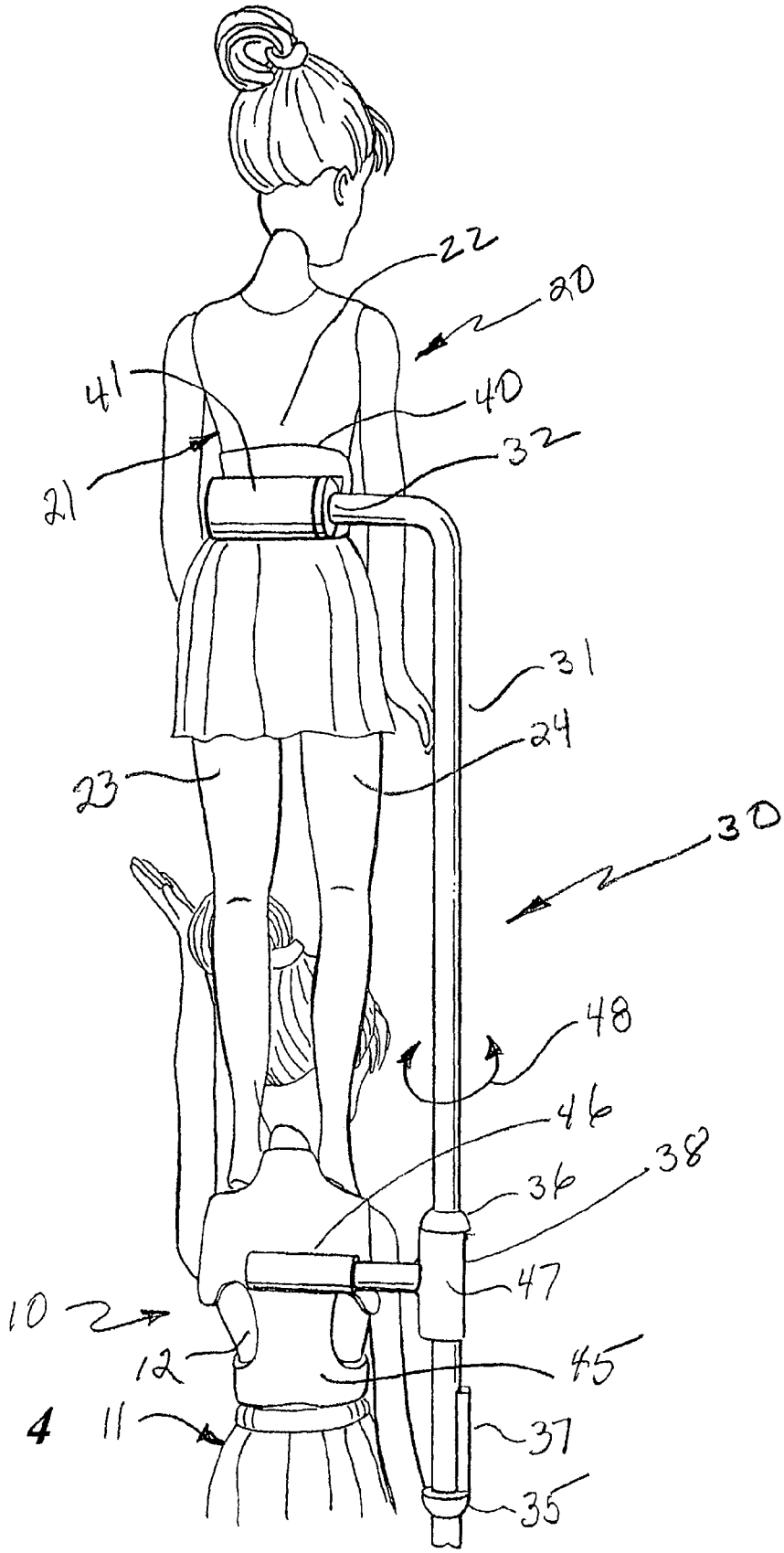
FIG. 4 sets forth a partial rear view of the present invention doll pair and apparatus in the shoulder stand position.

FIG. 4 sets forth a partial rear view of the present invention doll pair and apparatus in the shoulder stand position. As can be seen, apparatus 30 maintains doll 20 upon the shoulders of doll 10 in a typical shoulder stand position utilized in cheerleading activities.

It should be noted that the movement of rod 31 through sleeve 47 is essentially a free movement for the most part. This allows the child user to rotate rod 31 and thereby spin doll 20 in a cartwheel-like movement. Additionally, sleeve 47 defines an elongated slot 38 while rod 31 defines an elongated tab 37. As a result, the rotation of rod 31 within sleeve 47 may be inhibited by sliding rod 31 until tab 37 extends into slot 38. In this position, rotation of rod 31 is prevented. Thus, the user is able to initiate vertical movements such as those shown in FIGS. 1 through 3 in which doll 20 is raised upwardly as well as rotational or cartwheel-like movements such as those indicated by arrow 48 by rotating rod 31 within sleeve 47.

Figure 5:
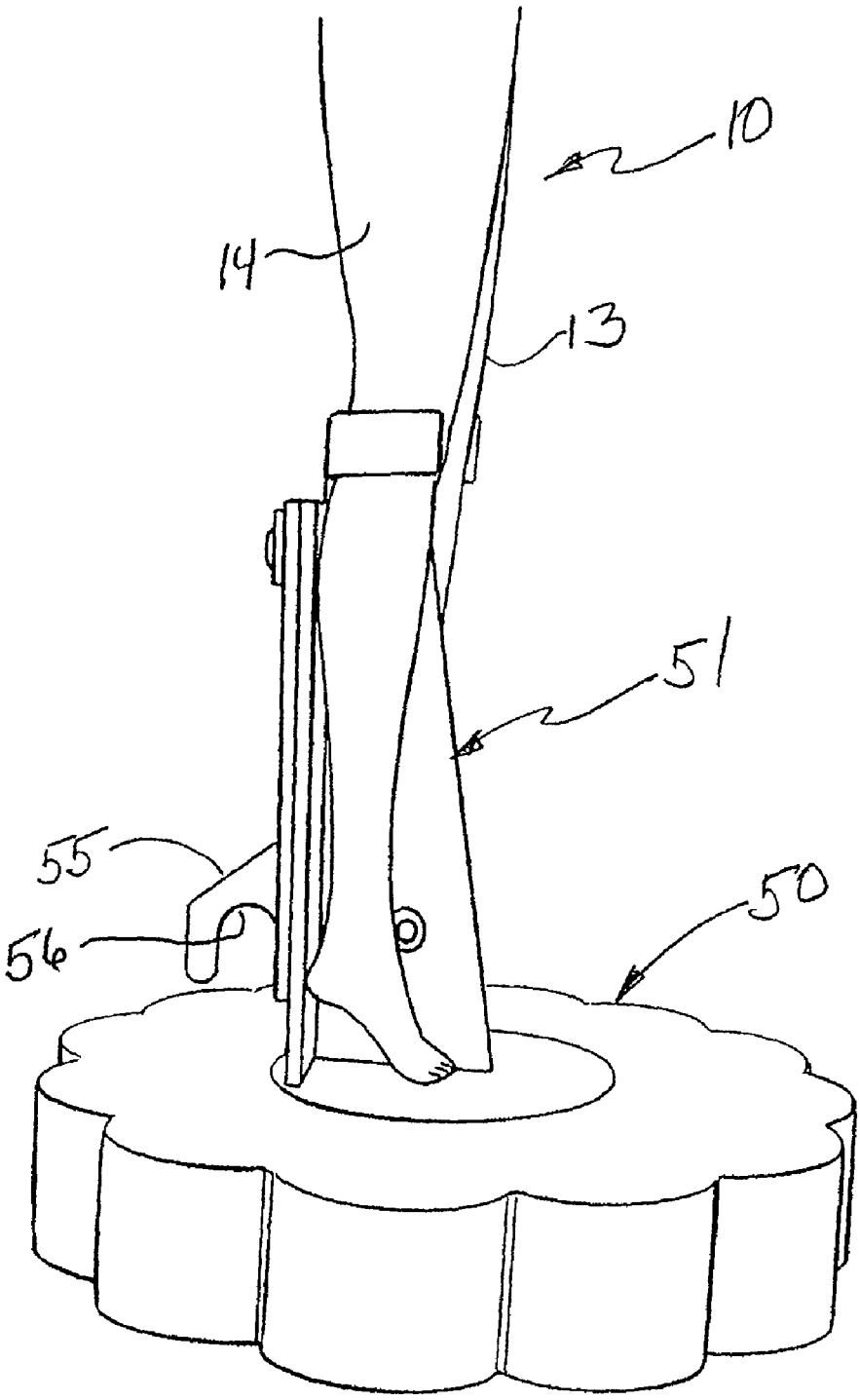
FIG. 5 sets forth a partial perspective view of the foot and leg attachment of the fixed doll upon the base of the present invention.

FIG. 5 sets forth a perspective view of base 50 supporting legs 13 and 14 of doll 10. Base 50 is preferably formed of a rigid relatively heavy material to provide a firm support for doll 10. Base 50 includes a vertically extending support 51 which receives legs 13 and 14 as shown. In addition, support 51 further includes a rotatable clasp 55. Clasp 55 is pivotally secured to support 51 by a pivot pin 54. Clasp 55 includes a notch 56. As described above, clasp 55 may be rotated from the position shown to an extending position in which notch 56 engages a portion of elongated rod 31 (seen in FIG. 3). This maintains the position of rod 31 in a locked vertical orientation such as that shown in FIG. 3.

Figure 6:
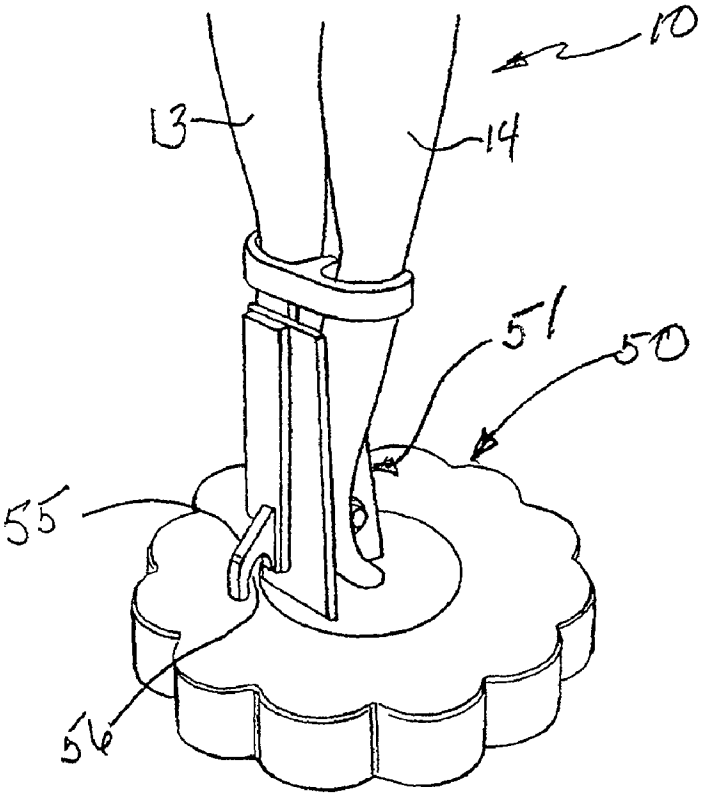
FIG. 6 sets forth a rear view of the support base and a portion of the attached doll legs of the present invention.

FIG. 6 sets forth a rear perspective view of base 50 supporting legs 13 and 14. Base 50 is preferably formed of a rigid relatively heavy material to provide a firm support for doll 10. Base 50 includes a vertically extending support 51 which receives legs 13 and 14 as shown. In addition, support 51 further includes a rotatable clasp 55. Clasp 55 is pivotally secured to support 51 by a pivot pin 54. Clasp 55 includes a notch 56. As described above, clasp 55 may be rotated from the position shown to an extending position in which notch 56 engages a portion of elongated rod 31 (seen in FIG. 3). This maintains the position of rod 31 in a locked vertical orientation such as that shown in FIG. 3.

Figure 7:
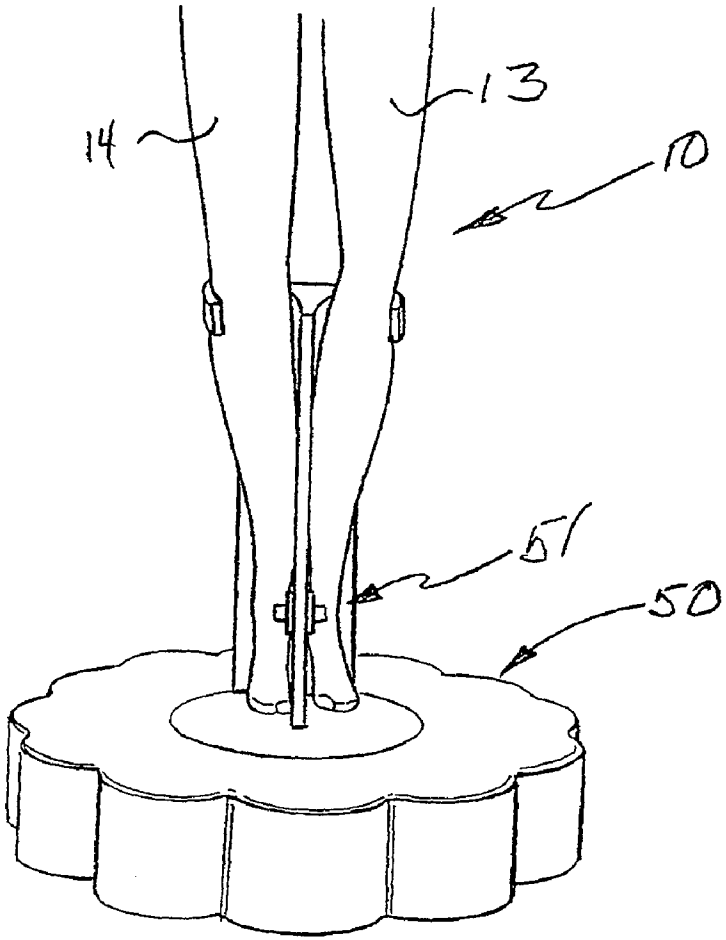
FIG. 7 sets forth a front view of the support base and a portion of the dolls legs of the present invention doll pair and apparatus.

FIG. 7 sets forth a front perspective view of legs 13 and 14 secured within support 51 upon base 50.

Figure 8:
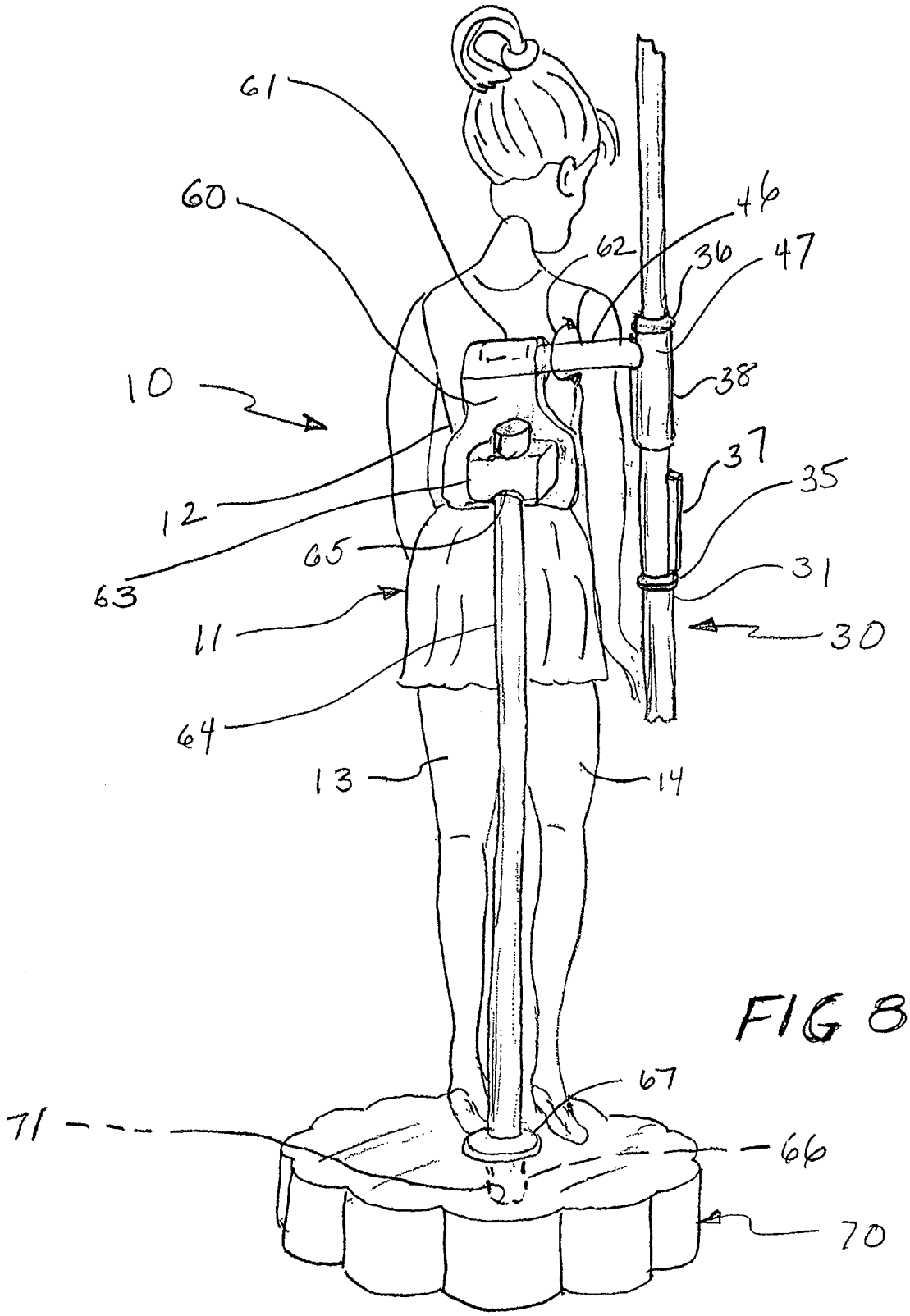
FIG. 8 sets forth a rear perspective view of an alternative embodiment of the present invention doll pair and apparatus characterized by the use of an alternative doll stand.

FIG. 8 sets forth a rear perspective view of an alternate embodiment of the present invention doll pair and apparatus. The embodiment of FIG. 8 is substantially identical to the embodiment of the present invention set forth above in FIGS. 1 through 7 with the difference being found in the use of an alternative support and base for maintaining doll 10 in an upright position and for pivotally supporting apparatus 30. Accordingly, FIG. 8 shows doll 10 supported upon the new base and supported by the alternative doll support structure. It will be understood that the remainder of the present invention doll pair and apparatus is but for these differences identical to the embodiment described above.

More specifically, doll 10 includes a doll body 11 having a rear torso 12 and a pair of legs 13 and 14. A base 70 defines a socket 71 which receives an end 66 of a vertical stand rod 64. Stand rod 64 further defines a flange 67 which stabilizes end 66 within socket 71. In further accordance with the alternate embodiment of FIG. 8, doll 10 is wearing a torso clasp 60 which is secured to rear torso 12 of doll 10 in a snap fit attachment similar to torso clasp 45 shown above in FIG. 1 worn by doll 10. Torso clasp 60 differs from torso clasp 45 however in that it provides a stand support 63 secured to the rear portion of torso clasp 60 which defines an aperture receiving end 65 of stand rod 64. Torso clasp 60 further includes a pivot support 61 which receives pivotal attachment 46. Pivot attachment 46 is pivotal within pivot support 61 as indicated by arrow 62.

The remainder of apparatus 30 is identical to apparatus 30 set forth above in FIGS. 1 through 7. Thus, apparatus 30 includes an elongated rod 31 supporting spaced apart beads 35 and 36 together with a tab 37. A slider 47 is slideably moveable upon rod 31 between beads 35 and 36 in the above described manner. Slider 47 is securely joined to pivotal attachment 46.

Thus, in accordance with the embodiment of FIG. 8, the use of leg support 51 (seen in FIG. 1) to maintain doll 10 in a vertical position upon the supporting base has been replaced by stand rod 64 and torso clasp 60. In all other respects however, doll 10 cooperates with apparatus 30 and is utilized in combination with doll 20 (seen in FIG. 1) to provide the above described play pattern for cheerleading stunts or like activities. As with the above described embodiments, doll 10 may be removed from torso clasp 60 due to its releasable snap fit attachment to allow doll 10 to be utilized in conventional play patterns typical of fashion dolls or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy apparatus, comprising:
a first doll;
a second doll;
a base having a support configured to support said first doll in a standing posture upon said base;
a first torso clasp secured to said first doll;
a second torso clasp secured to said second doll; and
a stunt apparatus having an elongated rod having a longitudinal axis, a first end forming a handle, a second end pivotally joined to said second torso clasp, and an intermediate pivot between said first and second ends pivotally joining said elongated rod to said first torso clasp, the pivot being coupled to the first torso clasp, the elongated rod and the pivot being rotatable about an axis that is defined by the pivot and that is oriented substantially perpendicular to the longitudinal axis of the elongated rod.

2. The toy apparatus set forth in claim 1, wherein said intermediate pivot includes a slide that is movable upon said elongated rod.

3. The toy apparatus set forth in claim 2, wherein said elongated rod includes a pair of spaced-apart beads and said slide is positioned upon said elongated rod between said beads.

4. The toy apparatus set forth in claim 2, wherein said slide defines a slot and said elongated rod includes a tab receivable within said slot to prevent pivoting movement of said slide upon said elongated rod.

5. The toy apparatus set forth in claim 3, wherein said slide defines a length and said beads are spaced-apart by a distance greater than said length of said slide.

6. The toy apparatus set forth in claim 4, wherein said slide is movable on said elongated rod between a first position engaging said tab and a second position free of said tab.

7. The toy apparatus set forth in claim 1, wherein the support is a leg support engaging said first doll.

8. The toy apparatus set forth in claim 1, wherein the support includes a support rod having a first end received in said base and a second end received in said first torso clasp.

9. The toy apparatus set forth in claim 8, wherein said base defines a socket receiving said first end of said support rod and the support rod includes a support flange in contact with said base.

10. A toy apparatus, comprising:
a first doll having a torso;
a second doll having a torso;
a base having a support configured to support said first doll in an upright posture upon said base;
a first torso clasp secured to said torso of said first doll;
a second torso clasp secured to said torso of said second doll; and
a stunt apparatus having an elongated rod defining a longitudinal axis, a handle end, a distal end pivotally coupled to said second torso clasp, and an intermediate pivot between said handle end and said distal end pivotally joining said elongated rod to said first torso clasp, the pivot being coupled to the first torso clasp, the elongated rod and the pivot being rotatable about an axis that is defined by the pivot and that is oriented substantially perpendicular to the longitudinal axis of the elongated rod,
said elongated rod being pivoted about said first torso clasp by moving said handle end to raise or lower said second doll.

11. The toy apparatus set forth in claim 10, wherein said first and second torso clasps are snap-fit attachable and removable to and from said first and second dolls.

12. The toy apparatus set forth in claim 10, wherein said intermediate pivot includes a slide movable upon said elongated rod.

13. The toy apparatus set forth in claim 12, wherein said elongated rod includes a pair of spaced-apart beads and said slide is positioned upon said elongated rod between said beads.

14. The toy apparatus set forth in claim 12, wherein said slide defines a slot and said elongated rod includes a tab receivable within said slot to prevent pivoting movement of said slide upon said elongated rod.

15. The toy apparatus set forth in claim 13, wherein said slide defines a length and said beads are spaced-apart by a distance greater than said length of said slide.

16. The toy apparatus set forth in claim 14, wherein said slide is movable on said elongated rod between a first position engaging said tab and a second position free of said tab.

* * * * *